US005135230A

United States Patent [19]

Denman et al.

[11] Patent Number: 5,135,230

[45] Date of Patent: Aug. 4, 1992

[54] BASEBALL FRANCHISE GAME

[76] Inventors: Peter J. Denman, 595 Webb Hill Rd., Stamford, Conn. 06903; Joseph Agliotta, 58 Friendlee La., Wilton, Conn. 06897

[21] Appl. No.: 814,572

[22] Filed: Dec. 30, 1991

[51] Int. Cl.[5] ..... H63F 3/00

[52] U.S. Cl. ..... 273/244; 273/256

[58] Field of Search ..... 273/242, 243, 244, 245, 273/247, 256, 259

[56] References Cited

U.S. PATENT DOCUMENTS

| | | | |
|---|---|---|---|
| 2,026,082 | 12/1935 | Darrow | 273/256 |
| 4,000,897 | 1/1977 | York | 273/244 X |
| 4,010,957 | 3/1977 | Tricoli | 273/244 X |
| 4,027,882 | 6/1977 | Rosenberg | 273/247 |
| 4,210,335 | 7/1980 | Licciardi | 273/244 X |
| 4,486,022 | 12/1984 | Dixon | 273/256 |
| 4,832,346 | 5/1989 | Pierce | 273/247 |
| 5,071,136 | 12/1991 | Lott | 273/259 |

FOREIGN PATENT DOCUMENTS

| | | | |
|---|---|---|---|
| 2051590 | 1/1981 | United Kingdom | 273/247 |

*Primary Examiner*—George J. Marlo
*Assistant Examiner*—William E. Stoll
*Attorney, Agent, or Firm*—Edward R. Hyde

[57] ABSTRACT

A board game that simulates a baseball club franchise in which the objective is to maximize income and team player quality. Commercial baseball cards are used having real life players and their playing statistics. The winning point score depends upon the monetary income and the baseball card player statistics.

8 Claims, 2 Drawing Sheets

BASEBALL FRANCHISE GAME

BACKGROUND OF THE INVENTION

1. Field of the Invention

The present invention relates to a board game and more particularly one in which a player establishes and builds a sports organization such as a baseball franchise club.

Each player represents a baseball franchise and plays through a season in which the particular events occur that help or hinder his team and provide income or loss of income as a result of various events. These events are the ones that would normally occur to a team franchise throughout a season of play. Examples of the events are injuries to players, a player in a slump and sent to a minor league team, the purchase of a player from another team, contracting free agents, etc.

The board game simulates the real life events that occur to the team. A particularly novel feature of the present invention is the use of commercially available baseball cards.

2. Description of the Prior Art

A large number of board games exist representing sports events or business enterprises and examples of these are shown in U.S. Pat. Nos. 4,027,882 and 4,486,022. However, neither of these patents nor others in the prior art contemplate the use of commercially available baseball cards in which the game players represent baseball teams and the game contemplates playing through a season.

3. Summary of the Invention

The game of the present invention is played on a board having a path along which playing pieces are moved. The path contains squares having indicia of the various events that can befall a baseball team throughout the season. Each player has a playing piece and in sequence rolls a die to advance his playing piece along the path on the board. As a playing piece comes to rest within a particular square, that player's team is subject to a designated event. It is understood that the events can either help or hurt a team and can provide income or expense to the club.

The purpose of the game is to enhance the quality of the team and receive income for the franchise. At the end of the game, the winner is determined by combining together the monetary income for the season plus points representing the quality of the team in terms of its players. The team quality is determined by the playing statistics of each player as represented on the commercial playing cards that each game player has at the end of the game.

Accordingly it is a primary object of the present invention to provide a game board that stimulates the building up and playing of a baseball team during a season in which commercially available baseball cards are employed.

Another object of the present invention is to provide a baseball franchise game board using baseball cards representing real life baseball players in which each card contains the actual statistics of the player represented on the card.

Another object of the present invention is to provide a baseball franchise game board in which each game player represents a franchise baseball club and the object of the game is to build up and enhance the team by acquiring quality players represented by baseball cards of real life players and their respective baseball statistics.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF THE PREFERRED EMBODIMENT

Figure 1:
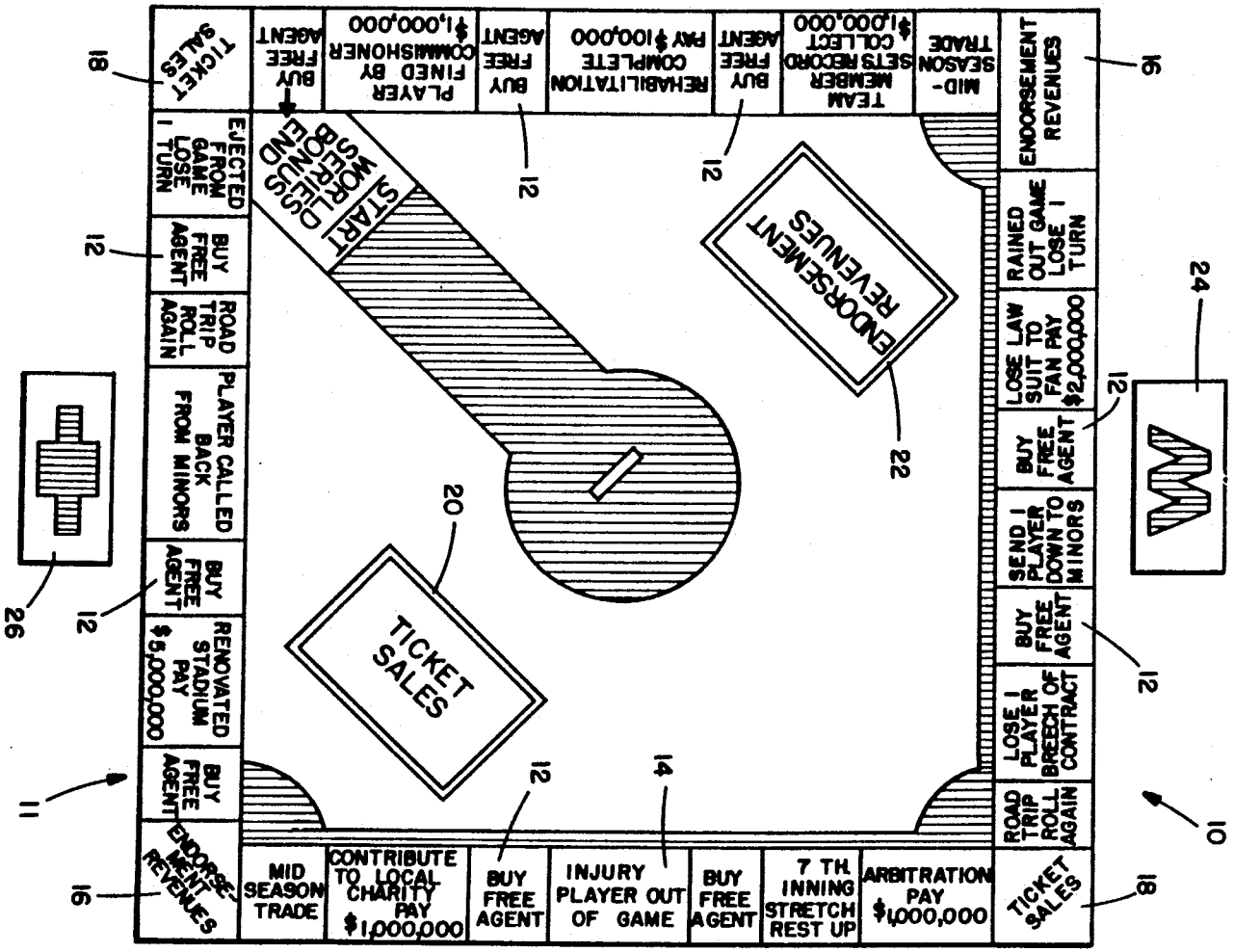
FIG. 1 is a plan view of the board used in the game of the present invention.

Referring now to FIG. 1, numeral 10 represents the board used in the game which may have a rectangular path 11 divided into spaces each of which has indicia representing a particular event. A major event in playing the game is that of buying a free agent and it is seen that each side of the square path contains a number of spaces 12 each of which has the notation Buy Free Agent. Another event is that of injury to a player who must be put on the injured list and taken out of the game and spaces 14 is so designated.

Some events do not directly effect the composition of the team or the players but are monetary producing or costing. Thus squares 16 are designated endorsement revenues and squares 18 are ticket sales events.

In playing the game various cards are used and placed in any convenient location. Thus a supply of ticket sales cards 20 and endorsement revenue cards 22 are shown in FIG. 1 as located on the game board. Similarly, a supply of minor cards 24 and medical cards 26 are located adjacent the board. The use of these cards will be described hereinafter in considering the sequence of a game play.

Figure 3:
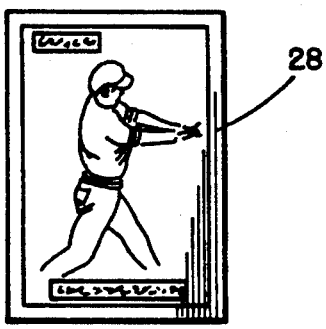
FIG. 3 is the face of a commercially available baseball card illustrating a real life player.
Figure 4:
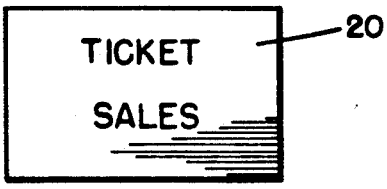
FIG. 4 illustrates ticket sales cards.
Figure 6:
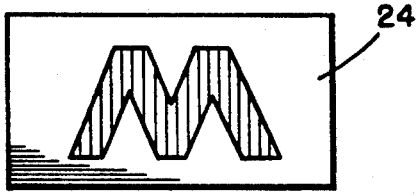
FIG. 6 illustrates minor cards.
Figure 5:
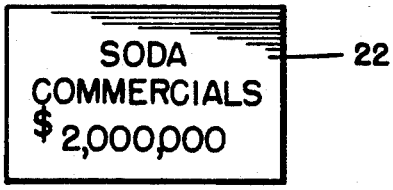
FIG. 5 illustrates product endorsement cards.
Figure 7:
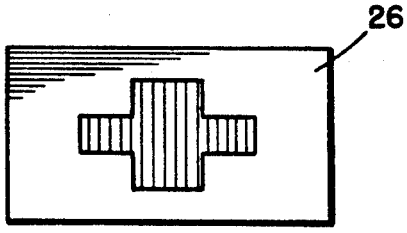
FIG. 7 illustrates medical cards.
Figure 8:
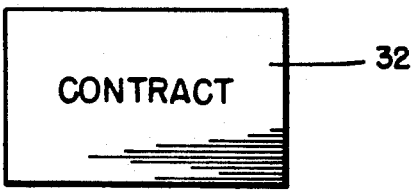
FIG. 8 illustrates contract cards.
Figure 10:
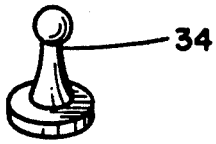
FIG. 10 illustrates a playing piece.
Figure 9:
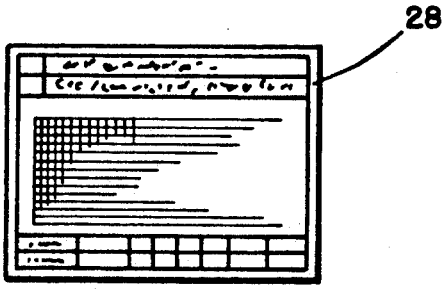
FIG. 9 illustrates the reverse side of the baseball card of FIG. 3.
Figure 11:
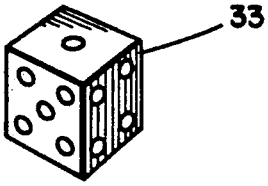
FIG. 11 is a die.

Referring now to FIGS. 3 and 9 there is shown a baseball card 28 of the type that are popularly collected by baseball fans. The front face of the card as shown in FIG. 3 conventionally has a picture of a living or deceased baseball player whereas the reverse side of the card as shown in FIG. 9 contains playing statistics of the particular player. Conventionally the statistics are by year with the average statistics to date in a line near the bottom of the reverse side of the card. An especially novel feature of the present invention is that the game utilizes these cards and in particular the statistics of the major league player illustrated on the card.

The play of a game may proceed in the following manner.

Figure 2:
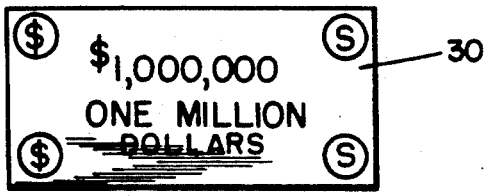
FIG. 2 illustrates play money.

Each player is given a supply of play money 30 as shown in FIG. 2 and among the players a banker is chosen. The supply of endorsement cards 22 are placed in the designated location on the board and ticket sales cards 20 are placed in another designated location. The medical cards 26 and minor cards 24 are placed in locations next to the board. A supply of contract cards 32 is provided, each of which has a monetary amount printed on one side, and this supply is placed alongside the board at any convenient location with the face sides showing the dollar amount facing down so that the amounts cannot be seen by the game players. Alongside the contract cards, there is placed a supply of baseball cards faced up and these may be either in a pile or spread out so that the game players may see the various player cards. It is understood that these baseball cards are of the type that is commercially available and customarily collected by baseball fans.

Each player takes a playing piece 34 which may be of various colors so that each player knows his own playing piece during the play of the game. The playing pieces may be put on the starting square that in the board of FIG. 1 is labelled ticket sales at the home plate corner of the board. The game play of the pieces is in a counter clockwise direction along the path. Each player will roll the die 33 to determine who should go first and the subsequent sequence. The players then in succession roll the die and move the playing piece the number of spaces indicated on the die. The player then proceeds according to the directions set forth on the space he has landed on and these acts are self-explanatory by the indicia designation in each space.

When landing on the space designated by a free agent the player will draw a baseball card from the supply along with a contract card from the stack of contract cards 32. He will turn over the contract card which will tell him the price he must pay for the player he has selected and he will then place the contract card on the bottom of the pile and place the baseball card in front of him. In this manner, each player will build up a team of baseball players for which he has paid a contract price.

In a similar manner as playing piece comes to rest on another square, the player will proceed with the designated act. Thus, if he lands on the square reading mid-season trade, his players are up for bid or trade to any other team of the game players. Another square indicates an injured player out of the game and if the playing piece lands in this square the player to the right takes a medical card 24 and places it on any of the baseball cards of the game player whose piece landed on the injury space. Similarly there are squares indicating that a player is sent to the minors in which case the player on the right will pick a minor card and place it on the baseball card of the player whose piece landed on that space. In a similar manner, there are spaces that call for a player coming back from the minors in which case the minor card is removed from the baseball card and that baseball player is back available to the game player.

There are spaces indicating payments to the game players such as ticket sales and endorsement revenues. If a playing piece 34 comes to rest in one of these spaces the player will pick a ticket sales card or endorsement card and on the reverse side will be a monetary amount that he will receive from the banker.

Additional spaces designate further events that may befall a team franchise. Examples shown in the path of FIG. 1 include Lose 1 Player, Breach of Contract, Rained-Out Game, Lose 1 Turn, Mid-Season Trade, Ejected from Game, Lose 1 Team, etc.

The game proceeds around the board until the last free agent baseball card has been used and received by a game player. After that the die is continually rolled in sequence by the individual players and the pieces are moved around the board until the first player lands exactly on the World Series bonus space at which time the game is ended.

The winner is determined by adding up the cash that his team has at the end of the game and the monetary amount may be converted to points as follows:

$10,000,000—100 pts.
$5,000,000—50 pts.
$1,000,000—10 pts.
$100,000—1 pt.

Each player then takes all of the baseball player cards that he has accumulated during the game and totals up the points using the chart below. He will not count any of his players that at the end of the game are still injured or sent down to the minors.

AVG.
.000-.100—5 pts.
.101-.200—10 pts.
.201-.300—15 pts.
.301-above—20 pts.

HR
0-100—1 pt.
101-200—2 pts.
201-300—3 pts.
301-400—4 pts.
401-500—5 pts.
501-600—6 pts.
601-700—7 pts.
701-800—8 pts.
801-above—9 pts.

RBI
0-100—1 pt.
101-200—2 pts.
201-300—3 pts.
301-400—4 pts.
401-500—5 pts.
501-600—6 pts.
601-700—7 pts.
701-800—8 pts.
801-900—9 pts.
901-above—10 pts.

After the worth of the players is determined and converted to points these points are added to those representing the play money dollars and the total represents the score of each of the game players. The player with the most points wins the game.

Thus it is seen that in progressing around the path, the game player's pieces may land on spaces that provide players (represented by baseball cards 28) to the franchise or remove players as by injury (medical cards) or sending to the minors. Removed players may be returned by the appropiate spaces marked Player Called Back or Rehabilitation Complete.

In addition to the acquisition and loss of player spaces, another group of spaces provides or costs money. In this manner, there are two criteria that determine the worth of the franchise. Accordingly the two criteria are converted to game points and the total of the two indicates the success of the franchise during the season and the winner of the game.

As is well known, many baseball fans collect baseball cards of living and deceased major league players. The present invention provides a game for these fans to use their card collections.

Having thus described the invention with particular reference to the preferred forms thereof, it will be obvious that various changes and modifications may be made therein without departing from the spirit and scope of the invention as defined in the appended claims.

What is claimed is:

1. A board game for a plurality of players in which each player represents the owner of a professional baseball club franchise and seeks to maximize financial worth and team quality comprising:

a game board having a closed path of contiguous spaces;

said spaces having indicia of events that occur to a baseball club during a season of play;

a plurality of movable pieces to be moved along the said path of spaces;

chance means for determining the movement of the pieces along the board path;

a quantity of play money;

a plurality of baseball cards each having on one side a picture of a major league baseball player and on the other side his playing statistics;

a plurality of contract cards each having a monetary value thereon; and said indicia of events including a first event indicia indicating the drawing of a baseball card and a contract card designating the monetary cost of the drawn baseball card that must be paid whereby a player may draw a baseball card and contract card upon his movable piece being located in a space having said first event indicia.

2. A board game as set forth in claim 1 including:

a plurality of income cards having markings thereon indicating a monetary amount;

said indicia of events including second event indicia indicating the drawing of an income card whereby a player may draw an income card upon his movable piece being located in a space having said second event indicia.

3. A board game as set forth in claim 1 including:

a plurality of disability cards having markings thereon indicating the removal of a baseball card from game play;

said indicia of events including second event indicia indicating the drawing of a disability card whereby a disability card is drawn upon his movable piece being located in a space having said second event indicia.

4. A board game as set forth in claim 3 wherein said indicia of events includes third event indicia indicating the removing of a disability card and the return of a baseball card to game play.

5. A board game for a plurality of players in which each player represents the owner of a professional baseball club franchise and seeks to maximize financial worth and team quality comprising:

a game board having a closed path of contiguous spaces;

said spaces having indicia of events that occur to a baseball club during a season of play;

a plurality of movable pieces each representing a respective player to be moved along the said path of spaces;

chance means for determining the movement of the individual movable pieces along the board path;

a quantity of play money;

a plurality of baseball cards each having on one side a picture of a major league baseball player and on the other side his major league playing statistics;

a plurality of contract cards each having a monetary value thereon;

said indicia of events including a first event indicia indicating the drawing of a baseball card and a contract card designating the monetary cost of the respective baseball card that must be paid;

a plurality of ticket sales cards and a plurality of endorsement cards each having a monetary value thereon;

said indicia of events including second and third event indicia indicating the drawing respectively of a ticket sales card and endorsement card designating the monetary amount that is received by a game player;

a plurality of minor cards and a plurality of medical cards;

said indicia of events including fourth and fifth event indicia indicating the drawing respectively of a minor card and medical card resulting in the loss of a baseball card; and sixth event indicia indicating the return of a baseball card player from a loss resulting from a minor card and medical card.

6. A board game as set forth in claim 5 wherein the indicia of events includes seventh event indicia indicating the removing of a minor and medical card and the return of a baseball card to the game player.

7. A board game for a plurality of players in which each player represents the owner of a professional baseball club franchise and seeks to maximize financial worth and team quality represented by a combined point score comprising:

a game board having a closed path of contiguous spaces;

said spaces having indicia of events that occur to a baseball club during a season of play;

a plurality of movable pieces to be moved along said path of spaces;

chance means for determining the movement of the pieces along the board path;

a quantity of play money;

a plurality of baseball cards each having on one side a picture of a major league baseball player and on the other side his playing statistics;

a plurality of contract cards each having a monetary value thereon;

said indicia of events including a first event indicia indicating the drawing of a baseball card and a contract card designating the monetary cost for the drawn baseball card that must be paid;

a plurality of income cards each having a monetary value thereon;

said indicia of events including second event indicia indicating the drawing respectively of an income card designating the monetary amount that is received by a game player;

a plurality of baseball card deleting cards;

said indicia of events including third event indicia indicating the deletion of a baseball card whereby at the end of a game a game player has a supply of money and baseball cards each of which may be converted to a number of game points that are added together for total game points for each player.

8. The board game set forth in claim 7 wherein said indicia of events includes fourth indicia indicating the removal of a baseball card deleting card and the return of a deleted baseball card to a game player.

* * * * *